United States Patent [19]

Wexler

[11] Patent Number: 4,650,175

[45] Date of Patent: Mar. 17, 1987

[54] MICROFICHE FEEDING MECHANISM

[76] Inventor: Elias Wexler, 196 Johnson Rd., Scarsdale, N.Y. 10583

[21] Appl. No.: 665,624

[22] Filed: Oct. 29, 1984

[51] Int. Cl.[4] ..... B65H 3/06

[52] U.S. Cl. ..... 271/10; 271/145; 271/170; 271/19

[58] Field of Search ..... 271/10, 19, 21, 145, 271/160, 170, 109, 119, 118, 169, 120, 121, 126, 127, 171

[56] References Cited

U.S. PATENT DOCUMENTS

| | | | |
|---|---|---|---|
| 135,599 | 2/1973 | Scholfield | 271/119 |
| 3,406,627 | 10/1968 | Becker | 271/119 X |
| 4,106,763 | 8/1978 | Tani et al. | 271/127 |
| 4,219,192 | 8/1980 | Burke | 271/127 X |
| 4,395,034 | 7/1983 | Fukui | 271/21 |
| 4,437,656 | 3/1984 | Onada et al. | 271/119 |

*Primary Examiner*—George E. A. Halvosa
*Assistant Examiner*—Matthew C. Graham
*Attorney, Agent, or Firm*—Pasquale A. Razzano

[57] ABSTRACT

A sheet feeding mechanism for feeding individual sheets of material, such as for example microfiche folders, is disclosed which includes a tray mounted in a frame and having a pivoted bottom wall. A pair of sheet retaining claws are pivotally mounted on the tray and positioned at the corners thereof at the front of the open front edge of the tray to normally block movement of the sheet in a stack supported on the bottom wall from moving forwardly out of the tray. The bottom wall is spring biased upwardly, and an advancing device is provided for advancing individual sheets from the top of the stack. The advancing device includes a rotating cam having a sector shape enlargement formed thereon for engaging the top sheet of the stack as the cam rotates. The enlargement urges the stack downwardly against the spring bias on the pivoted bottom wall while also urging the top sheet in the stack in the direction of the rotation of the cam. This moves the corners of the top sheet against the claws, causes the sheet to buckle, and to separate from the stack, whereby the sheet is fed over the claws and away from the stack.

2 Claims, 8 Drawing Figures

10
12
14
16
36
38
40
42
44
46
52
54
56
57
62
64
70
72
74
84
96
100
120
130
140
A

MICROFICHE FEEDING MECHANISM

The present invention relates to sheet feeding devices, and more particularly to a sheet feeding device for use in feeding microfiche files one at a time from a stack.

BACKGROUND OF THE INVENTION

A variety of different types of sheet feeding mechanisms have been previously proposed for a number of different purposes in the prior art. For example, individual sheet feeders are used with conventional photocopying machines to transmit one sheet of paper at a time to the machine from a stack in a cassette. The purpose of these cassettes is to simplify loading and unloading of the sheets and to improve the speed of operation of the photocopying machine or the like.

The previously proposed sheet feeding device generally include a tray or holder of some type, which includes claws or the like arranged to block movement of sheets from the stack in a forward or sheet feeding direction, except to permit movement of only the top sheet in response to a sheet feeding arrangement. Two such devices are disclosed for example in U.S. Pat. Nos. 4,131,274 and 4,033,577.

While these previously proposed devices have been generally satisfactory for use in connection with the feeding of individual paper sheets from a stack, they have not been found by applicant to be satisfactory for use in dealing with special purpose sheets or materials.

In particular, it has been found that it is very difficult to feed or distribute one sheet at a time of microfiche file folders from a stack, other than by manually separating the file folders. These file folders or envelopes specifically consist of two layers of polyester film, such as for example the film sold under the trademark Mylar by the Dupont Corporation which are joined together to form an individual packet, file or envelope. These films are joined together along grid lines which define channels in which microfiche film can be stored. Due to the nature of the film material, there is a substantial tendency for adjacent files or envelopes to adhere to one another in a stack. It is believed that this natural adherence is a result of humidity and static electricity, which forces create an adherence greater than the natural adherence of paper sheets to one another. In addition, because of the smoothness or slickness of the envelope surface, it is difficult to keep the envelopes aligned during movement. Thus, it has been found that conventionally proposed sheet feeding mechanisms for paper stacks are unsatisfactory in handling stacks of microfiche files, folders or envelopes.

SUMMARY OF THE INVENTION

Accordingly, it is the object of the present invention to provide a sheet feeding mechanism for microfiche file folders, or envelopes.

Another object of the present invention is to provide a sheet feeding mechanism which is relatively simple in construction and durable in operation.

A further object of the present invention is to provide a sheet feeding mechanism which is relatively simple to construct and reliable in operation.

In accordance with an aspect of the present invention, the sheet feeding mechanism disclosed herein is adapted to feed individual sheets of microfiche file envelopes or folders from a stack, one sheet at a time. The sheet feeding mechanism includes a frame and a tray mounted in the frame for holding the stack of microfiche folders. The tray includes a pair of side walls and an integral rigid backwall, as well as an open front edge. The space tray also includes a mobile bottom wall which is pivotally mounted to and between the side walls at a position nearer to the back wall than to the frontwall. The pair of sheet retaining claws are respectively pivotally mounted on the side walls of the tray with the claws having first legs extending along the side walls, second legs extending perpendicular to the first legs but in front of the front edge of the tray, near the side walls, and retention fingers extending from these second legs rearwardly over the bottom wall, thereby to overlie a stack of folders on the bottom wall.

The mobile bottom wall of the tray is biased upwardly by resilient biasing means in the frame, thereby causing the bottom wall normally to rotate about its pivotal mounting towards the top of the tray. A cam arrangement is provided for advancing individual sheets from the top of a stack in the tray, one at a time. The biasing means biases the bottom wall and lifts the stack of file folders thereon upwardly toward the cam, and keeps the top sheet of the stack constantly engaged with the cam. The cam includes an enlargement thereon which engages the top sheet of the stack once each revolution. When the enlargement is opposed to the top sheet of the stack it urges the stack downwardly against the biasing means and pushes the stack downwardly while at the same time urging the top sheet in the direction of rotation of the cam. To move the corners of the top sheets against the claws. This causes the top sheet to buckle against the claws, while operating from the sheets below it in the stack, and ultimately to stack over the claws for movement in the direction of rotation out of the tray. From there the individual file film is advanced along a conveyor system through a printer or other mechanism, as desired so that each file folder or envelope can be individually treated or acted upon by a printer or hole punch or the like.

The above, and other objects, features and advantages of this invention will be apparent in the following detailed description of an illustrative embodiment thereof, which use is to be read in connection with the accompanying drawings, wherein:

DETAILED DESCRIPTION

Figure 1:
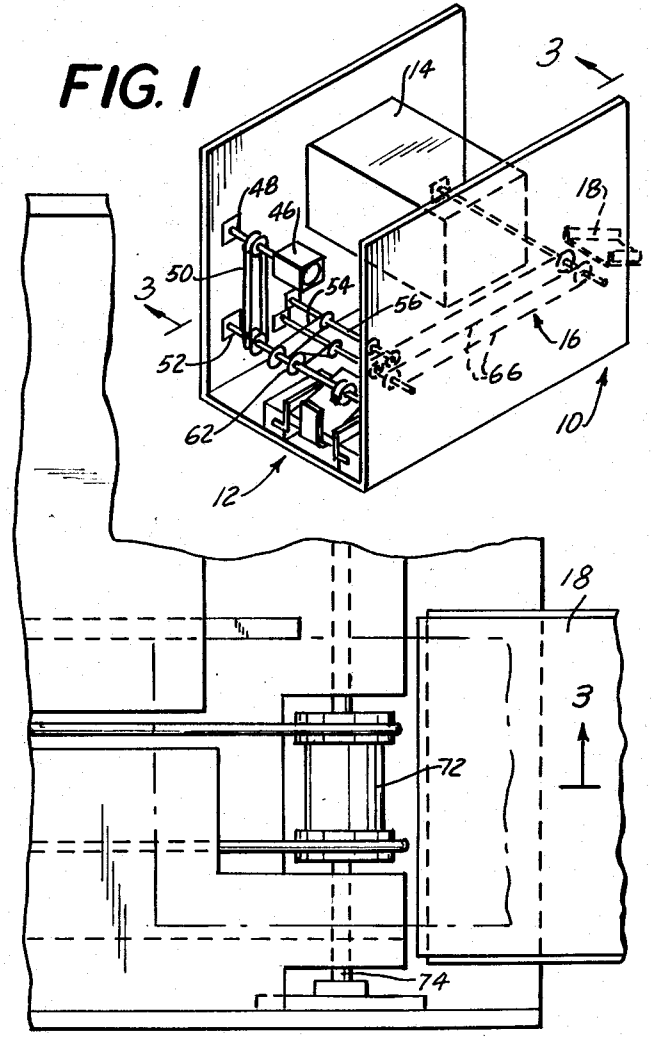
FIG. 1 is a schematic perspective view of a printing device utilizing the sheet feeder of the present invention.
Figure 2:
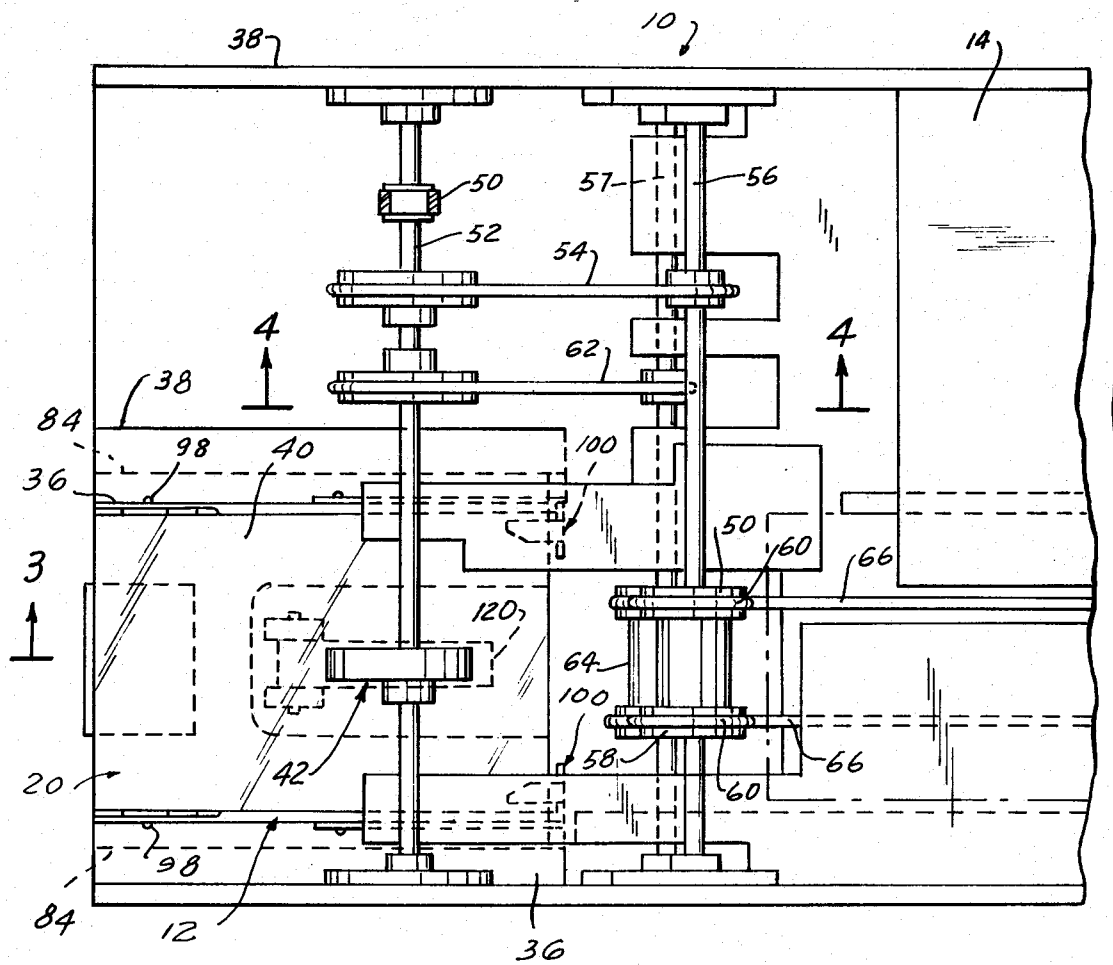
FIG. 2 is a partial top plan view on an enlarged scale of the device shown in FIG. 1.

Referring now to the drawing in detail, and initially to FIG. 1, a printing device 10 for use in printing patient information or the like on a microfiche file folder or envelope is illustrated. The printing device 10 includes a sheet feeding mechanism 12, constructed in accordance with the present invention, a printer 14 of conventional construction, and a conveyor arrangement 16 for transporting the microfiche file folders or envelopes from the sheet feeder past the printer then on to a collector or auxillary tray 18.

Figure 5:
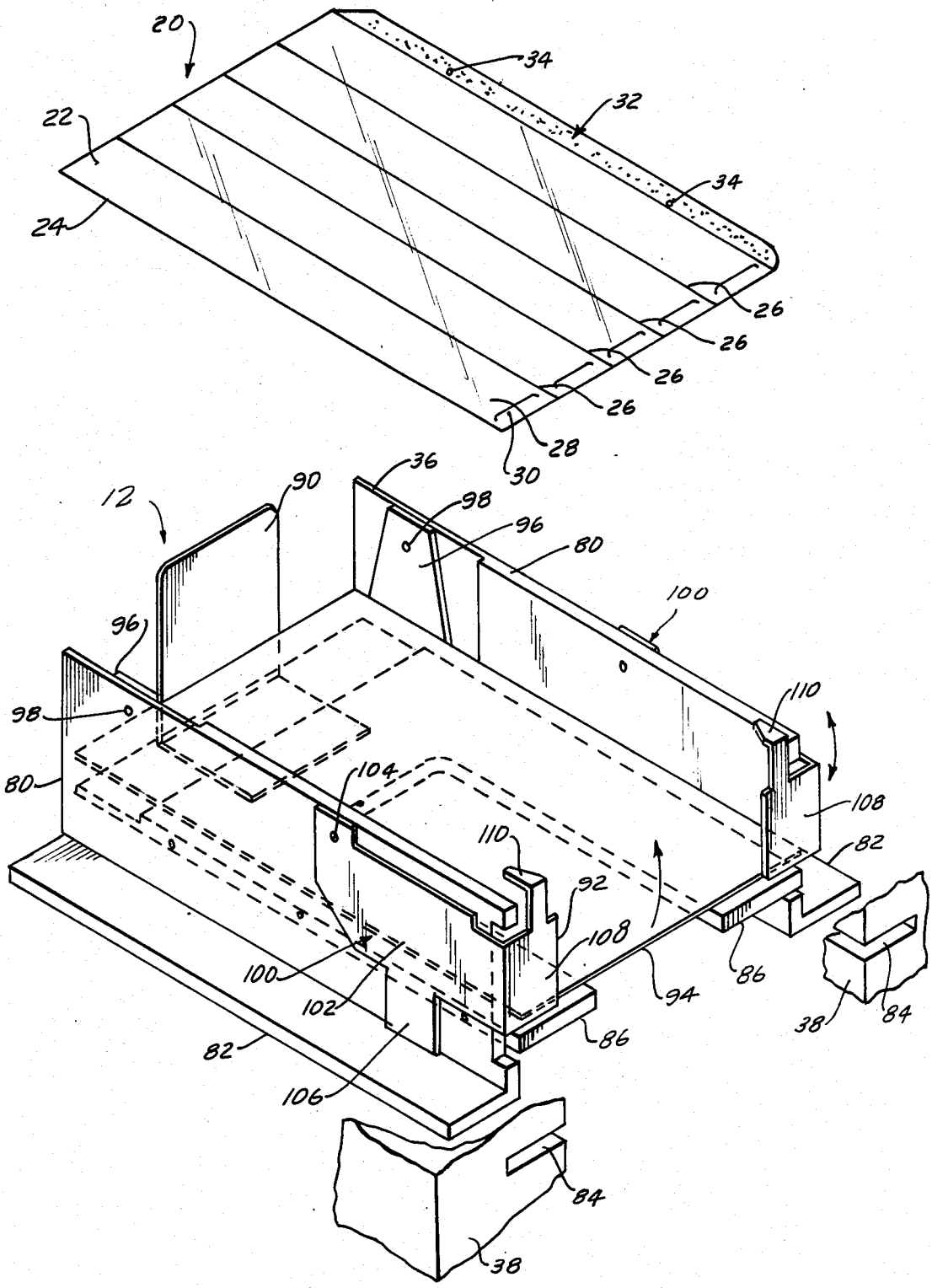
FIG. 5 is an enlarged perspective view of the tray utilizing the sheet feeding mechanism of the present invention.

The microfiche file folders or envelopes (hereinafter referred to as envelopes) are illustrated in FIG. 5. As seen therein an envelope 20, which is of conventional construction, includes upper and lower films 22, 24 formed typically of Dupont polyester film sold under the trademark Mylar. The film is joined in a conventional and known manner along seams 26 as well as along all four of its edges, as by heat sealing or the like. This forms a plurality of channels 28 between the seams. One of the layers 22, has slots 30 formed therein along one of its edges, to permit manual or automatic insertion of a microfiche film strip into its associated channel 28. One edge 32 of the envelope may be formed with a special treatment 34 thereon to permit retention of printed information.

In one application, for example in a hospital, an individual microfiche envelope will contain microfiche records of a particular patient. It is desirable to store these records in an easily retrievable fashion, for example by patient name. Therefore, it is necessary to print the patient's name on the envelope which contains the microfiche records.

Figures 3, 4:
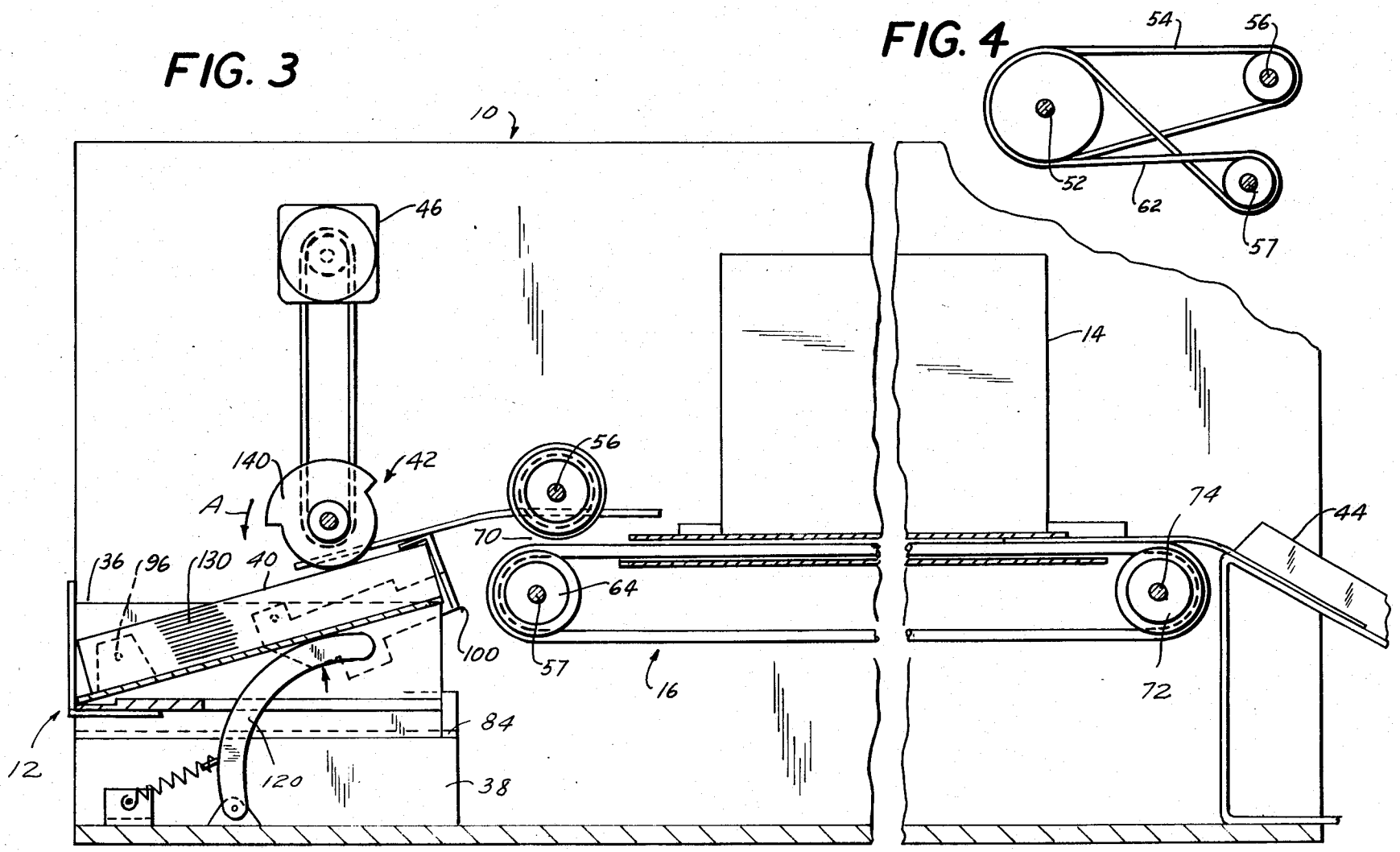
FIG. 3 is a side sectional view, taken along line 3—3 in FIG. 1.
FIG. 4 is a partial side sectional view of the drive for the device of FIG. 1, taken along line 4—4 of FIG. 2.

The upper microfiche envelope in a stack 40 contained in the tray 36 mounted in frame 38, as described hereinafter, is advanced in the direction of rotation of the cam 42, as indicated by the arrow A in FIG. 3 towards the printer 14, when the microfiche envelope is released from the tray, as described hereinafter, it is engaged by the conveyor system 16 and moved beneath the printer 14 where the printing operation takes place.

Preferably, the system is designed with electronic controls (not shown) of conventional construction so that the cam 42 operates in one revolution and stops, to advance the film from the tray onto the conveyor 16 which simultaneously then advances the film to a position beneath the printer 14 and in turn stops. The printer 14 is then operated, and the sequence is then repeated to advance the next film onto the conveyor 16 to a position below the printer 14. At the same time the previously printed envelope moves with the conveyor 16 from the printer 14 into the collection tray 44.

The drive arrangement for the invention can be formed in any convenient manner. Preferably the drive includes an electrical motor 46 of conventional construction, which can be operated in discrete steps under the control of a control system, described above but not discussed herein in detail, because it is of a known and conventional construction. The drive motor 46 is connected to a shaft 48 which, through a drive belt 50, drives the shaft 52 on which the cam 42 is mounted. An additional drive belt 54, as seen in FIGS. 1 and 4 serves to transmit rotation from the shaft 52 to a first auxiliary shaft 56. This shaft has a pair of rollers 58 mounted thereon including friction drive belts 60 secured to their periphery.

An additional drive belt 62 transmits rotation from the shaft 52 to a roller 64 mounted on shaft 57. The roller 64 serves to drive a pair of friction belts 66 guided thereover. The rollers 58 are spaced above the roller 64 to form a small nip 70 between the friction belts 60 and 66 which will engage the leading edge of a microfiche envelope leaving the tray 36 and advance it forward along the belts 66, as seen in FIG. 8 into a position beneath the printer 14.

The belts 66 are also trained at their opposite end over a roller 72 mounted on an idling shaft 74.

Figure 6:
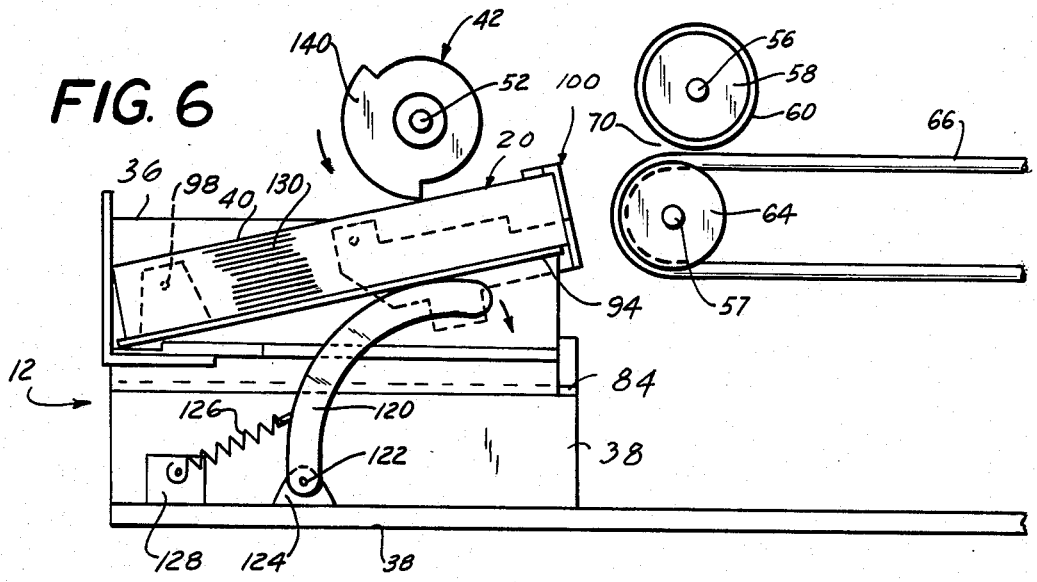
FIGS. 6, 7 and 8 are sequential views showing the operation of the sheet feeding mechanism of the invention.
Figure 7:
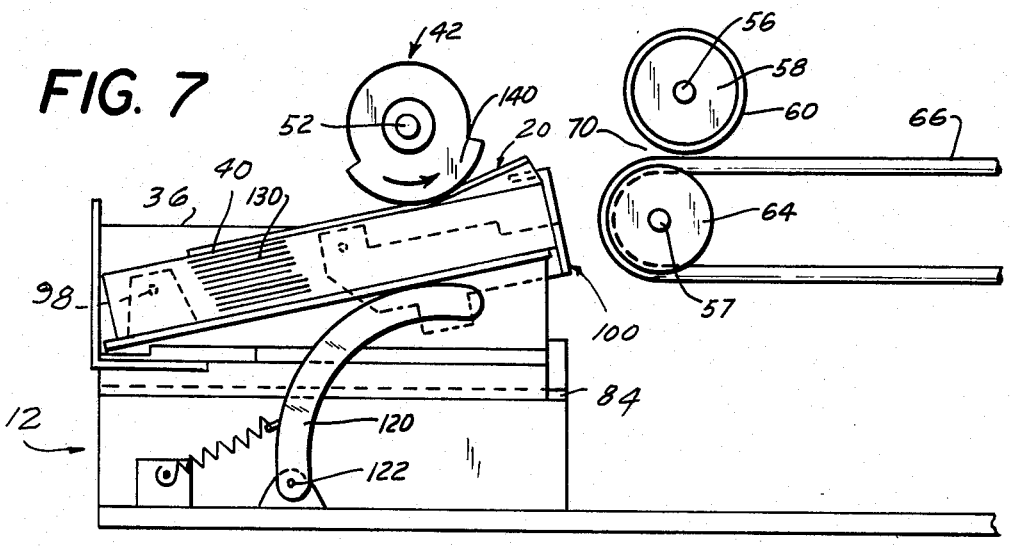
Figure 8:
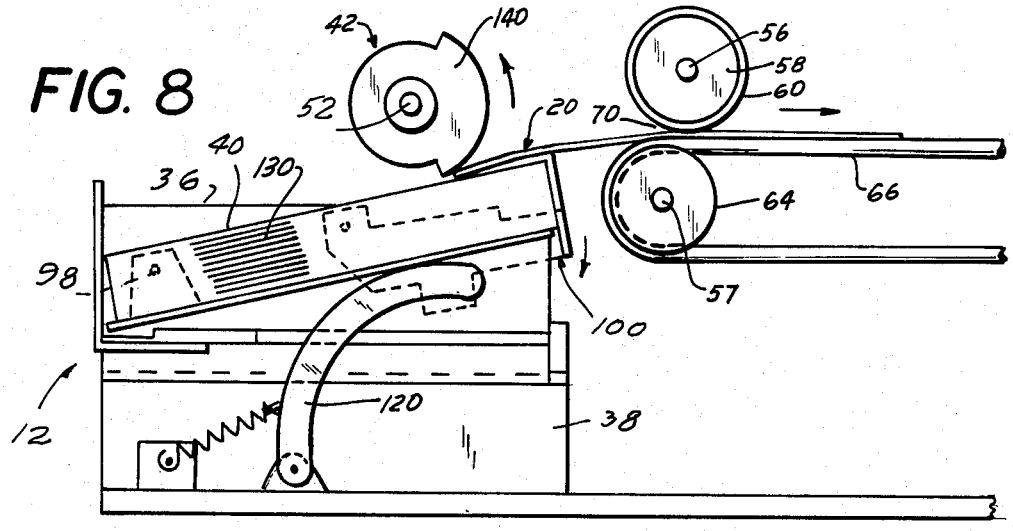

Referring now in further detail to FIGS. 3 and 5–8 it is seen that the tray 36 has a pair of sidewalls 80 which include laterally extending flanges 82. These flanges are slidably received in slots 84 in the frame 38 of the device to permit the tray to be conveniently inserted and removed from the device 10. These slots are in a generally horizontal position as seen in FIGS. 6 through 8. The tray includes a rigidly connected bottom wall 86 having an opening 88 therein. In addition a backstop element 90 consisting of an L shaped member secured to the bottom wall 88 is provided. The side walls of the tray also define a front open edge 92. The dimensions of the tray are selected such that a stack of microfiche envelopes will fit within its walls relatively tightly, but with a degree of freedom of movement.

Tray 36 also includes a mobile bottom wall 94. This bottom wall has ears formed thereon near the rear wall 90 of the tray, and which are pivotally connected to the side walls 80 by pins 98 or the like in any convenient manner. As seen in FIG. 5, the inner surfaces of the side walls 80 are recessed slightly to accommodate the ears 96, so that the ears do not interfere with the stack of microfiche envelopes supported in the tray. With this arrangement the bottom wall 94 of the tray can pivot about the pins 98 upwardly and downwardly, during the operation of the device as described hereinafter. Of course, the rigid bottom wall 86 provides a bottom stop for downward pivotal movement of the mobile bottom wall 94.

A pair of sheet retaining claws 100 are respectively mounted on the side walls 80. These claws have first leg portions 102 pivotally mounted on pins 104 or the like on the side walls 80. These legs include stop members 106 formed thereon which engage the flanges 82 of the tray, to limit downward movement of the claws under the influence of gravity to a horizontal position, as seen in FIG. 5. The claws additionally include second legs 108, perpendicular to the legs 102 which extend across the corners of the tray in front of the front wall opening 92 thereof. These legs serve to prevent forward movement of the sheets in a stack contained in the tray. Finally, the claws include fingers 110 projecting rearwardly from the legs 108, to be located above the sheets in a stack contained in the tray. As seen in FIG. 5, the fingers 110 are dimensioned such that they generally align with the top surface of the side walls 80 when the tray is empty. In operation, the tray normally would not be filled with a stack of microfiche envelopes having a height greater than the height of the side walls 80.

The sheet feeding mechanism 12 also includes a biasing lever 120 mounted in the frame 38 of the device. This lever is generaly arcuate in shape, as seen in FIG. 6 and is pivotally mounted by a pin 122 or the like on a boss 124 in the bottom of the frame. The lever is pivotally biased in a counter clockwise direction, as seen in FIG. 6, by a spring 126 or the like connected between the lever and a further boss 128 in the frame. In this way the lever is biased upwardly through the opening 94 bottom wall 86 of the tray into engagement with the mobile bottom wall 94 the rigid bottom wall 86 of the tray into engagement with the mobile bottom wall 94 of the tray. This urges the bottom wall 94 upwardly in a counter clockwise direction, as seen in FIGS. 6–8 to cause the top of the stack, and in particular the top most envelope in the stack to engage the surface of the cam 42. Obviously this engagement limits upward or counter clockwise rotation of the stack. In addition, this rotation of the stack under the influence of the lever 120 causes the claws 100 to pivot about their pivot pins 104 to hold the front end of the stack on the bottom wall and prevent inadvertent movement of the stack off the front end of the bottom wall of the tray.

In operation of the device the motor 46 is sequenced, in a step wise manner as described above, to cause one rotation of the cam 42 at a time. The cam initially starts in approximately the position illustrated in FIG. 3 and rotates in a counter clockwise direction as seen therein. Initial rotation of the cam is such as to cause slight movement of the top most envelope towards the front of the tray, which movement is blocked by the engagement of the microfiche envelopes with the legs 108 of the claws. After a short period of time, the enlargement 140 on the cam engages the top most sheet of the tray, and causes the tray to move downwardly. At the same time because of the increased diameter of the cam enlargement, there is an increased driving force applied to the top most envelope in the tray, causing it to move against the front legs 108 of the claws and to ultimately have the corners of the envelope buckle, as seen in FIG. 7. It is believed that the downward movement of the tray and the envelopes on the stack, as well as this increased force improves the release of the adhesion forces between the polyester film material. Ultimately, continued rotation of the cam 42 will cause the buckled corners of the envelopes to release from under the fingers 110 of the claws, freeing the top most envelope for continued movement in the direction of rotation of the cam, into position at the nip 70 between the rollers 58 and 64. It is noted that the downward movement of the tray bottom 94 also causes the top most envelope in the stack to move into alignment with this nip, to aid in a firm grasp of the envelope by the belts 60, 66. From this position the belts move the envelope 20 to the printer 14 where it is acted upon.

When the enlargement 140 leaves engagement with the top most envelope in the stack, the stack is freed to move upwardly again towards the narrower diameter portion of the cam roller. This action completes a somewhat fanning like action in the stack, which is believed to aid in separating individual polyester envelopes one from another and to assist in free separation of the envelopes upon actuation of the cam roller.

As seen in FIGS. 6–8, the enlargement 140 of the cam roller is generally sector shaped, having an included angle of about 135 degrees. Although the precise angle is not a critical aspect of the invention, it is important that the cam have an enlargement or lobe thereon in order to insure the pivotal movement of the stack in the tray. Preferably the cam is formed of rubber or other similar material having a sufficient coeffient of friction to insure proper grasping and movement of the highly slick polyester envelopes.

By this invention applicant has found that normally adhesive polyester microfiche envelopes which have been exceedingly difficult to separate one from another on an individual basis, even manually, are readily and automatically separated and dispensed to a conveyor or other device for subsequent operations.

Although an illustrative embodiment of the present invention has been described herein with reference to the accompanying drawings, other changes and modifications may be effected therein by those skilled in the art without departing from the scope or spirit of this invention.

What is claimed is:

1. A microfiche file feeding mechanism for feeding individual microfiche files from a stack, one file at a time, from the top of a stack, comprising: a frame; a tray mounted in said frame and having side walls including top and front vertical edges; said side walls being spaced to permit the stack of files to fit relatively tightly therebetween a fixed bottom wall extending between said side walls to a horizontal front edge, said front vertical edges and said horizontal front edge cooperating to define a fully open front end for said tray bounded on three sides by said horizontal and vertical edges; a mobile bottom wall located within said tray above said fixed bottom wall, said mobile bottom wall having a front end adjacent said open front end of the tray and an opposed rear end, said mobile bottom wall including laterally spaced tabs extending upwardly therefrom near its rear end and being pivotally connected to said side walls of the tray at positions above the fixed bottom wall of the tray and near the top edges of said side walls whereby the mobile wall is mounted on said side walls for relative pivotal movement with respect to said fixed bottom wall and said side walls; a pair of sheet retaining claws respectively pivotally mounted on the side walls of said tray near said top edges thereof and positioned at the corners of the tray in front of said front vertical edges, said claws having first leg portions adjacent to said side walls, a first upright wall section located in front of said open front end of the tray across the respective front vertical edges of the side walls and perpendicular to said first leg portions and having a height substantially equal to the height of said open end to limit forward movement of the files in the tray upon pivotal movement of said mobile bottom wall and a second horizontal end portion perpendicular to said upright wall section to overlie files in a stack on the tray interiorly of said side walls whereby movement thereof is unrestrained by the side walls; said fixed bottom wall having an opening formed therein; an arcuately curved elongated lever having first and second end portions and a curved side portion extending therebetween, the first end portion of said lever being pivotally mounted in said frame below the tray and said curved side portion thereof being engaged with said mobile bottom wall through the opening in said fixed bottom wall; means for resiliently biasing said lever in constant engagement against said mobile bottom wall to urge said mobile bottom wall to pivot upwardly against the weight of a stack of files therein; and means for advancing individual files from the top of the stack, one at a time, comprising a rotating cam having a generally cylindrical configuration in cross-section including a sector shaped portion of increased radius constituting an enlargement having an inner included angle of less than 180°; said sector shaped portion being located successively to engage the top file of a stack as the cam rotates, said cam, said lever and said claws cooperating to urge the stack downwardly against the bias of said lever while also urging said top file in the direction of rotation of the cam to move the corners of said top sheet against said claws, thereby to buckle said top file against the claws to overcome the inherent adhesion between files resulting from static electricity and the nature of the microfiche file material whereby the top file is separated from the stack and feed over the claws, said lever biasing said bottom wall upwardly upon passage of the enlargement out of engagement with said top file to present the next file for engagement with the enlargement.

2. A file feeding device as defined in claim 1 further comprising an endless conveyor having a horizontal flight located adjacent to the front end of the tray for receiving the files from said cam, and a roller having a friction face opposite to said horizontal flight of the endless conveyor to grip said file therebetween.

* * * * *